US007167418B2

(12) United States Patent
Hallberg

(10) Patent No.: US 7,167,418 B2
(45) Date of Patent: Jan. 23, 2007

(54) TELEVISION INCLUDING A TIMER

(75) Inventor: Bryan Severt Hallberg, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 0 days.

(21) Appl. No.: 10/977,465

(22) Filed: Oct. 29, 2004

(65) Prior Publication Data

US 2005/0146989 A1 Jul. 7, 2005

(51) Int. Cl.

| | |
|---|---|
| ***G04F 10/00*** | (2006.01) |
| ***G04B 47/00*** | (2006.01) |
| ***G04B 19/00*** | (2006.01) |
| ***G04C 17/00*** | (2006.01) |

(52) U.S. Cl. ..... 368/107; 368/10; 368/223

(58) Field of Classification Search ..... 368/10, 368/223, 243, 76, 250, 110, 113, 3, 6, 107
See application file for complete search history.

(56) References Cited

U.S. PATENT DOCUMENTS

| | | | | |
|---|---|---|---|---|
| 3,898,644 | A * | 8/1975 | Baxter | 368/28 |
| 4,956,825 | A * | 9/1990 | Wilts et al. | 368/9 |
| 5,621,458 | A * | 4/1997 | Mann et al. | 348/231.5 |
| 5,668,915 | A * | 9/1997 | Baik et al. | 386/46 |
| 5,936,679 | A | 8/1999 | Kasahara | |
| 6,021,185 | A | 2/2000 | Staron | |
| 6,104,334 | A * | 8/2000 | Allport | 341/175 |
| 6,141,058 | A | 10/2000 | Lagoni et al. | |
| 2005/0015804 | A1 * | 1/2005 | LaJoie et al. | 725/44 |

OTHER PUBLICATIONS

Han, J S, Apparatus and method for monitoring electric home appliances using digital tv, Feb. 14, 2004, abstract.*

* cited by examiner

*Primary Examiner*—Vit Miska
*Assistant Examiner*—Jeanne-Marguerite Goodwin
(74) *Attorney, Agent, or Firm*—Marger Johnson & McCollom P.C.

(57) ABSTRACT

The invention relates to an improved interactive television having a timer. The timer alerts a television viewer of the expiration of preset timers. For example, the preset timers may be associated with events not traditionally related to television content, such as a kitchen timer. The exemplary kitchen timer can alert a television viewer that a baking time has expired. Thus, the timer can manage alerts in a non-intrusive manner to enhance the viewer's experience.

6 Claims, 2 Drawing Sheets

TELEVISION INCLUDING A TIMER

FIELD

This invention relates generally to a television and, more particularly, to an improved television having a timer.

BACKGROUND

People watch television while involved in other tasks. A television may be sufficiently displaced to allow a viewer to lose track of the tasks. For example, if the task has a timer, then the television viewer may not receive sufficient notification from the timer's alarm. If the task does not have an alarm the television may provide too much of a distraction for the viewer to remember the task.

For example, cooks often prepare meals watching television. While television viewing can be a welcome distraction, televisions are often not in the kitchen. In such cases, cooks ignore kitchen timers because they are not conveniently viewed or heard. Generally, people watch television while conducting some other task or while being out of a reasonable notification range of a timer or alert for that other task.

Accordingly, a need remains for a television with a timer. The television timer should be easily viewed and allow timing of multiple events. The television should provide an alert for timer expiration and allow easy interaction with the timer.

BRIEF DRAWING DESCRIPTION

The foregoing and other objects, features, and advantages of the invention(s) will become more readily apparent from the detailed description of invention embodiments that references the following drawings.

DETAILED DESCRIPTION

Figure 1:
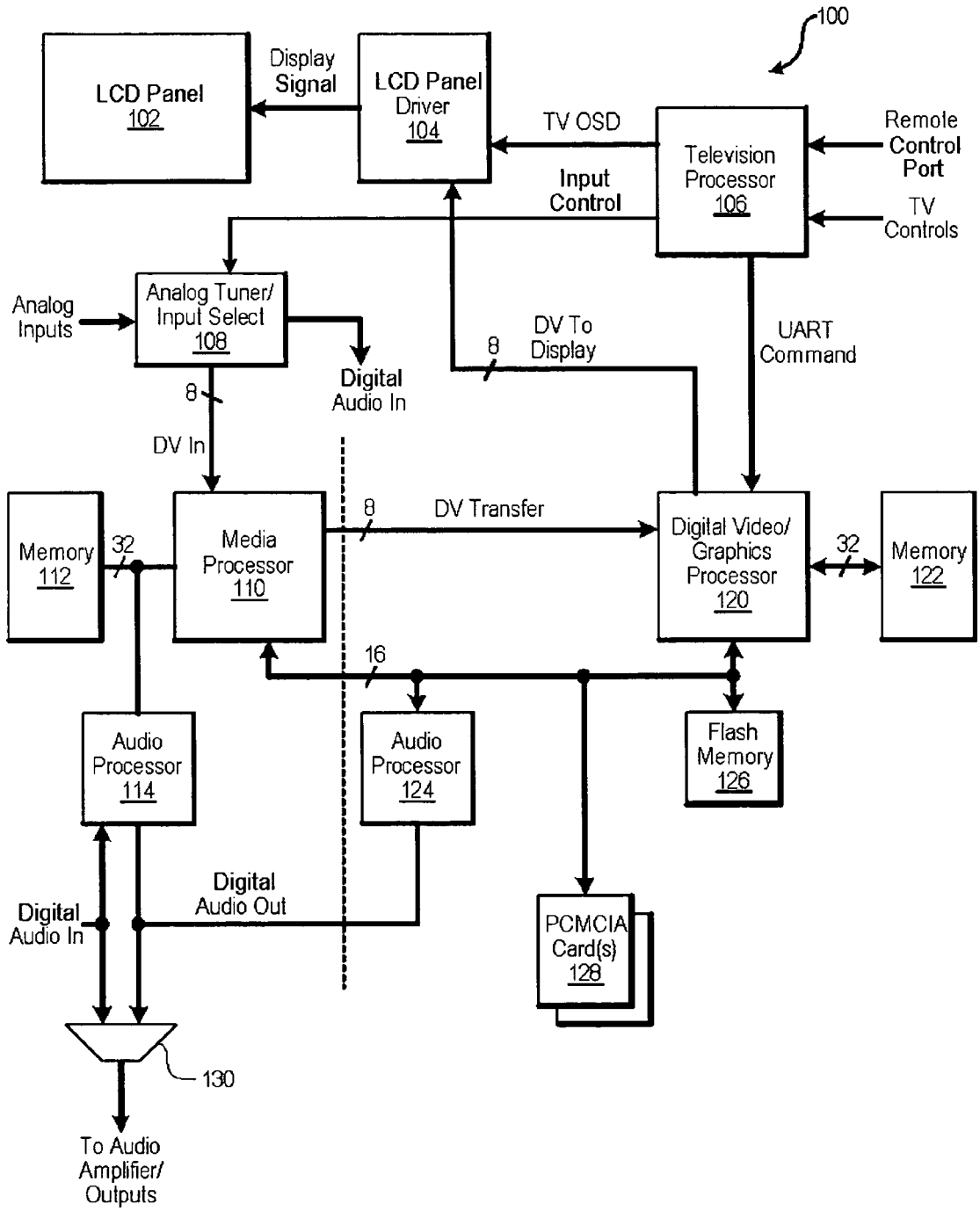
FIG. 1 is a block diagram of a television system embodiment that implements the kitchen timer.

Embodiments of the invention allow a television user to quickly and easily set, manage, and use one or more timers displayed with a television. Therefore, viewers can watch television and set timers for events not related to typical television content, namely, not related to broadcast, record or playback of traditional television content. For convenience, like numerals in the description refer to like structures in the drawings. The invention described herein provides an apparatus and method for a television with a timer.

FIG. 1 is a block diagram of a television system embodiment that implements a timer. For example, a kitchen timer manager that programs, displays, and otherwise manages timers may be implemented in one or a plurality of the blocks shown in FIG. 1. Referring to FIG. 1, the television 100 includes a panel 102 having a fixed pixel structure, e.g., a liquid crystal display (LCD), plasma display, or any television screen or the like. For simplicity, we refer to panel 102 as an LCD panel. Television 100 contains an LCD panel 102 to display visual output to a viewer based on a display signal generated by an LCD panel driver 104. LCD panel driver 104 accepts a primary digital video signal in CCIR656 format (eight bits per pixel YCbCr, in a "4:2:2" data ratio wherein two Cb and two Cr pixels are supplied for every four luminance pixels) from a digital video/graphics processor 120. A person of reasonable skill in the art should recognize that the LCD panel driver 104 may accept a primary digital video signal in formats other than CCIR656 and still come within the scope of the present invention.

A television processor 106 provides basic control functions and viewer input interfaces for television 100. Television processor 106 receives viewer commands, both from buttons located on the television itself (TV controls) and from a handheld remote control through the Remote Control Port. The Remote Control Port may accept input from the remote control in a variety of manners including infrared and radio waves as are well known in the art.

Based on the viewer commands, television processor 106 controls an analog tuner/input select section 108, and also supplies viewer inputs to a digital video/graphics processor 120 over a Universal Asynchronous Receiver/Transmitter (UART) command channel. Television processor 106 is also capable of generating basic On-Screen Display (OSD) graphics, e.g., indicating which input is selected, the current audio volume setting, etc. Television processor 106 supplies these OSD graphics as a TV OSD signal to LCD panel driver 104 for overlay on the display signal.

Analog tuner/input select section 108 allows television 100 to switch between various analog (or possibly digital) inputs for both video and audio. Video inputs can include a radio frequency (RF) signal carrying broadcast television, digital television, and/or high-definition television signals, NTSC video, S-Video, and/or Red Green Blue (RGB) component video inputs, although various embodiments may not accept each of these signal types or may accept signals in other formats (such as PAL). The selected video input is converted to a digital data stream, DV In, in CCIR656 format (or other formats) and supplied to a media processor 110.

Analog tuner/input select section 108 also selects an audio source, digitizes that source if necessary, and supplies that digitized source as Digital Audio In to an Audio Processor 114 and a multiplexer 130. The audio source can be selected—independent of the current video source—as the audio channel(s) of a currently tuned RF television signal, stereophonic or monophonic audio connected to television 100 by audio jacks corresponding to a video input, or an internal microphone.

Media processor 110 and digital video/graphics processor 120 provide various digital feature capabilities for television 100, as will be explained further in the specific embodiments below. In some embodiments, processors 110 and 120 can be TMS320DM270 signal processors, available from Texas Instruments, Inc., Dallas, Tex. Digital video/graphics processor 120 functions as a master processor, and media processor 110 functions as a slave processor. Media processor 110 supplies digital video, either corresponding to DV In or to a decoded media stream from another source, to digital video/graphics processor 120 over a DV transfer bus.

Media processor 110 performs coding and decoding of digital media streams for television 100, as instructed by digital video/graphics processor 120. Media processor 110 may perform MPEG (Motion Picture Expert Group) coding and decoding of digital media streams. A 32-bit-wide data bus connects memory 112, e.g., two 16-bit-wide×1M synchronous DRAM devices connected in parallel, to processor 110. An audio processor 114 also connects to this data bus to provide audio coding and decoding for media streams handled by media processor 110.

Digital video/graphics processor 120 coordinates (and/or implements) many of the digital features of television 100, including those that may be associated with the kitchen timer of the present invention. A 32-bit-wide data bus connects memory 122, e.g., two 16-bit-wide×1M synchronous DRAM devices connected in parallel, to processor 120. A 16-bit-wide system bus connects processor 120 to media processor 110, an audio processor 124, flash memory 126, and removable PCMCIA cards 128. Flash memory 126 stores boot code, configuration data, executable code such as may be necessary to implement aspects of the kitchen timer, and Java code for graphics applications, etc. PCMCIA cards 128 can provide extended media and/or application capability. Digital video/graphics processor 120 can pass data from the DV Transfer bus to LCD panel driver 104 as is, but processor 120 can also supercede, modify, or superimpose the DV Transfer signal with other content.

Multiplexer 130 provides audio output to the television amplifier and line outputs (not shown) from one of three sources. The first source is the current Digital Audio In stream from analog tuner/input select section 108. The second and third sources are the Digital Audio Outputs of audio processors 114 and 124. These two outputs are tied to the same input of multiplexer 130, since each audio processor is capable of tri-stating its output when it is not selected. In some embodiments, processors 114 and 124 can be TMS320VC5416 signal processors, available from Texas Instruments, Inc., Dallas, Tex.

Figure 2:
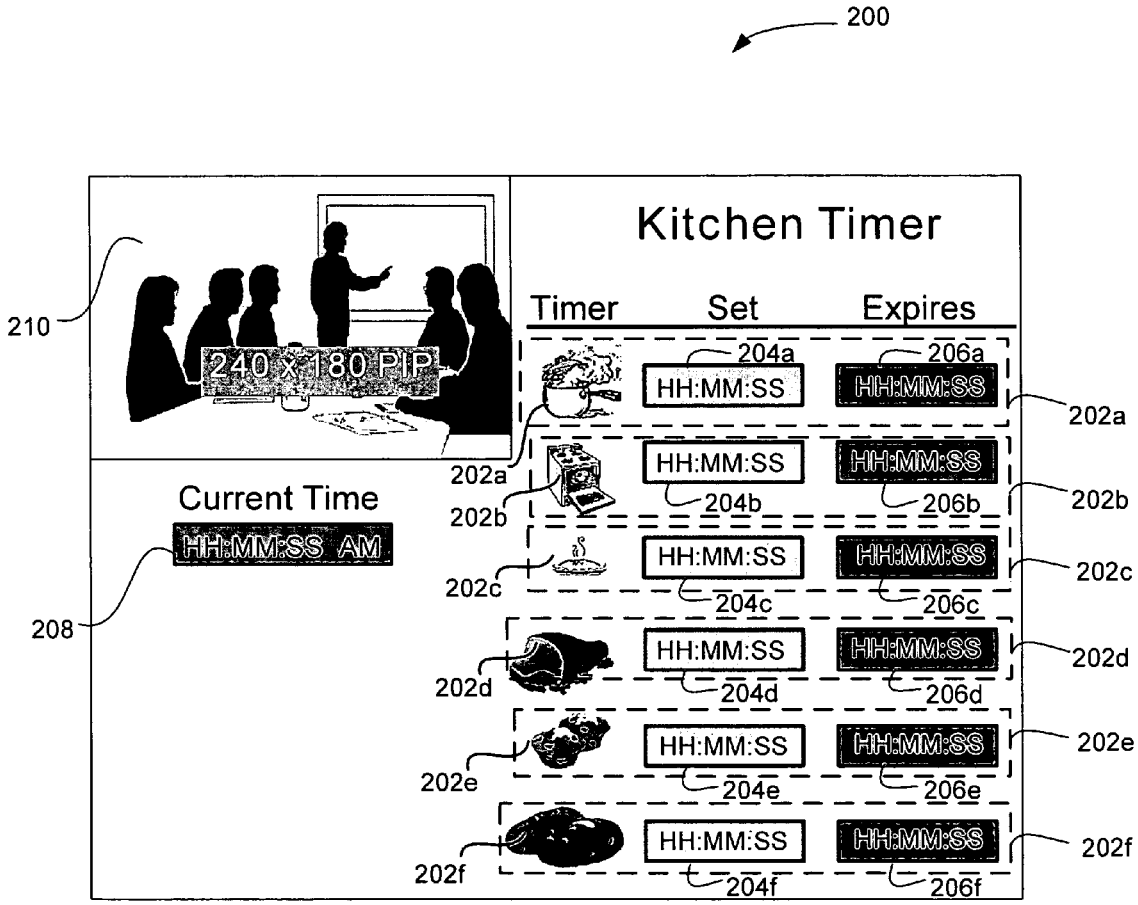
FIG. 2 is a television screen view of a kitchen timer according to an embodiment of the present invention.

FIG. 2 is a graphical user interface embodiment of a kitchen timer 200 displayed on the television 100. The kitchen timer 200 may be implemented using the processor 120, memory 122 or 126, and/or any other block shown in FIG. 1. The implementation in FIG. 2 shows six separate timers 221*a*–221*f*, each of which may be individually set to display timer information. Timer information may be any information corresponding to or useful for timing, controlling, or displaying events. For example, each timer 221*a*–221*f* may have an associated icon 202*a*–202*f* to aid the user in remembering the timer's assignment. For example, timer 221*a* is associated with a pot on a stove as indicated by the icon 202*a*. Each timer may show its originally set duration, e.g., originally set duration timers 204*a*–204*f*, as well as its remaining duration, e.g., remaining timers 206*a*–206*f*. The timer 200 may also show the current time of day 208 as well as the date (not shown).

Television content 210 may be shown concurrently with timer 200 information. For example, television content 210 is shown in the upper left corner such that the user can continue watching his desired content while viewing the kitchen timer 200. Or the kitchen timer 200 may shown in a corner while the content 210 is viewed on the remainder of the screen. A person of reasonable skill in the art should recognize that the content 210 and the kitchen timer 200 may be positioned in any of a variety of configurations for concurrent viewing. A person of reasonable skill in the art should realize that television content 210 may be broadcast content, applications, functions, or the like. Technology necessary for concurrently displaying content and the kitchen timer 200 is well known and will not be discussed in any further detail.

The kitchen timer 200 may overlay television content 210 using well known on screen display (OSD) technology. For example, television processor 106 may generate graphics, e.g., OSD graphics, indicating the timer 200. Television processor 106 may supply these OSD graphics as a TV OSD signal to LCD panel driver 104 for overlay on the panel 102.

The timers may be set in a variety of manners. The following description is only one example of a method of setting the timers. To set the timer, the user navigates a cursor to the desired timer, e.g., timer 221*a*. The user selects the timer 221*a*, enters the set time 204*a*, and presses a predetermined button on the remote control, e.g., the "Enter" button. The timer's "Set" value 204 is updated with its total duration and the "Expires" value 206*a* is updated with the amount of time remaining before timer expiration. If the user moves the cursor from a timer without pressing the "Enter" button, then the timer may revert to its previous value.

When a timer expires, it may send an alert to an alert manager as well as audibly or visually indicate the timer expiration to a viewer. The alert manager may be implemented in the television 100. The alert manager is explained in more detail in co-pending patent application titled INTERACTIVE TELEVISION ALERT MANAGER filed Mar. 31, 2004, to Bryan Hallberg et al., which we incorporate here by reference.

Preferably, the television 100 displays the alert with the associated icon 202, text (not shown), and chime (or other audible indication means). When the alert is selected, the timer application selects the expired timer so that the user may easily interact with the timer.

Although the invention has been described with reference to certain specific embodiments, various modifications thereof will be apparent to those skilled in the art without departing from the spirit and scope of the invention as outlined in the appended claims.

I claim:

1. An apparatus comprising:

a timer to provide timer information relating to a kitchen appliance; and a television coupled with the timer, the television to display timer information together with a graphical icon representing the kitchen appliance;

wherein the timer can be adjusted while timer settings are displayed on the television.

2. An apparatus comprising:

a timer to provide timer information relating to a kitchen appliance; and a television coupled with the timer, the television to display timer information together with a graphical icon representing the kitchen appliance;

wherein the timer information can be displayed concurrently with television content.

3. An apparatus comprising:

a timer to time events associated with a kitchen appliance; and a television coupled with the timer, the television to display information from the timer relating to the kitchen appliance;

wherein the timer can be adjusted while timer settings are displayed with the television.

4. An apparatus comprising:

a timer to time events associated with a kitchen appliance; and a television coupled with the timer, the television to display information from the timer relating to the kitchen appliance;

wherein the timer information can be displayed concurrently with television content.

5. An apparatus comprising:

a kitchen timer to time a kitchen appliance;

a television coupled with the kitchen timer, the television responsive to the kitchen timer;

wherein the timer can be adjusted while timer settings are displayed with the television.

6. An apparatus comprising:

a kitchen timer to time a kitchen appliance;

a television coupled with the kitchen timer, the television responsive to the kitchen timer;

wherein the timer information can be displayed concurrently with television content.

* * * * *

UNITED STATES PATENT AND TRADEMARK OFFICE

CERTIFICATE OF CORRECTION

PATENT NO. : 7,167,418 B2
APPLICATION NO. : 10/977465
DATED : January 23, 2007
INVENTOR(S) : Bryan Severt Hallberg It is certified that error appears in the above-identified patent and that said Letters Patent is hereby corrected as shown below:

Title Page, add Item [63] Related U.S. Application Data as follows:

--Nonprovisional of application 60/535,046, filed on January 6, 2004.--

Signed and Sealed this

Twentieth Day of January, 2009

JON W. DUDAS
*Director of the United States Patent and Trademark Office*